United States Patent [19]

Kominami

[11] Patent Number: 4,770,254

[45] Date of Patent: Sep. 13, 1988

[54] ROTARY HAMMER WITH BODY HAVING DETACHABLE SECTIONS

[75] Inventor: Masayoshi Kominami, Obama, Japan

[73] Assignee: Shibaura Engineering Works Co., Ltd., Tokyo, Japan

[21] Appl. No.: 803,266

[22] Filed: Nov. 29, 1985

[30] Foreign Application Priority Data

Nov. 26, 1985 [JP] Japan ..... 60-266864

[51] Int. Cl.[4] ..... B25D 11/02

[52] U.S. Cl. ..... 173/109; 173/122

[58] Field of Search ..... 173/48, 109, 122, 123; 30/122, 500

[56] References Cited

U.S. PATENT DOCUMENTS 2,206,614 7/1940 O'Hern ..... 30/500

4,280,359 7/1981 Schmid et al. ..... 173/48

4,529,044 7/1985 Klueber et al. ..... 173/48

*Primary Examiner*—E. R. Kazenske

*Assistant Examiner*—James L. Wolfe

*Attorney, Agent, or Firm*—Jordan and Hamburg

[57] ABSTRACT

A rotary hammer has a hammer body with an electric motor section which comprises a receiving section for receiving transmission mechanisms in a frame which serves as a shell barrel. A driving electric motor is installed in the shell barrel. The body also has a vibration and transmission mechanism section in which the transmission mechanisms including the motion conversion transmission mechanism and the vibrating mechanism are held by a bracket removably connected to the frame. In addition, the hammer body has a tool holding section in which the tool holding member for concomitantly rotatably holding the tool is rotatably supported by a bracket removably connected to the frame. The three sections are so arranged that they can be assembled and disassembled individually as separate component units.

4 Claims, 7 Drawing Sheets

C

ROTARY HAMMER WITH BODY HAVING DETACHABLE SECTIONS

BACKGROUND OF THE INVENTION

A rotary hammer, such as a hammer drill, is designed to impart axial percussive vibrations along with rotation to a tool, such as a drill bit, held at the front end of the hammer body, so as to perform chipping and drilling operations. The construction of such rotary hammer is disclosed, e.g., in U.S. Pat. No. 4,280,359, wherein a reciprocable piston-like drive member is installed in a cylinder which guides a vibrating mechanism disposed inside the hammer body, said drive member being adapted to be driven by an electric motor through a motion conversion transmission mechanism which converts rotary motion into axial reciprocating motion, the reciprocating motion of said drive member imparting axial percussive vibrations to a tool, such as a drill bit, held at the front end of the hammer body through a striker axially movably installed in the cylinder, and concurrently with this impartation, the rotation of the electric motor is reduced and imparted to a tool holding member which concomitantly rotatably holds the tool, whereby percussive vibrations and rotation are imparted to the tool.

In the conventional rotary hammer as described above, the cylinder provided with the piston-like drive member and striker, and the motion conversion transmission mechanism and electric motor which form a drive section for driving said piston-like drive member are received by a frame forming a shell barrel, while a bracket section for rotatably supporting the tool holding member at the front end of the hammer body and a bracket section for holding a bearing which supports one end of the rotor of the electric motor are integrally formed and fixed on said frame.

As a result, in assembling this rotary hammer, the tool holding member and electric motor must be built into the bracket which supports them before said bracket can be fixed to the frame and, moreover, after the electric motor and tool holding member have thus been built in, the bracket which holds the cylinder with the piston-like drive member and the motion conversion transmission device is fixed to the frame, a fact which, coupled with the substantial complexity of the internal construction, makes the assembly operation very troublesome. Further, disassembly operation which becomes necessary, e.g., when a machine trouble occurs is never easy as it must be performed in the order reverse to that for assembly operation. Particularly, the rugged the shell of the hammer body is made so as to have sufficient shock resistance to endure a long period of use, the more difficult the assembly operation.

In this type of rotary hammers, which requires operation performance tests, e.g., on the electric motor during assembly operation, if the hammer body is of unitary construction as described above, an operation performance test, e.g., on the electric motor must be conducted with not only the electric motor but also the bit or other tool holding section built into the shell barrel; thus, such test is very troublesome.

Further, in this type of rotary hammers, it often occurs that the internal mechanism breaks down or that the hammer fails to operate owing to the consumption of parts such as the sealing rings for the piston-like drive member. With the hammer body construction difficult of disassembly as described above, repair of damage or replacement of parts cannot be easily made in the field and the difficulty of disassembly often makes it necessary to carry the rotary hammer to the factory, during which time another rotary hammer has to be used.

For this reason, in another example of prior art, the shell serving as a frame for holding various parts is bisected along the axis of the vibrating mechanism to make it possible to open the shell to opposite sides. With this arrangement, although the assembly operation is easy, in disassembly all the parts are exposed and unnecessary parts are also disassembled. Moreover, since the split type shell halves on opposite sides must be clamped together as by screws, a number of fastening parts such as screws are required and the construction must be such that the fastening parts will not become loose under heavy shocks, a fact which makes disassembly operation more difficult. Further, the aforesaid split construction renders the parts liable to loosen, lowers the accuracy of assembly and fails to provide sufficient reliability in shock resistance; therefore, it is not preferable in practice.

Thus, it is less easy than expected to provide a rotary hammer which is easy to assemble and disassemble and which has high quality and high reliability. The fact is that rotary hammers are manufactured with it being admitted unavoidable that repair and replacement of parts take much time and labor.

Accordingly, I proposed a rotary hammer to solve the aforesaid problems (Japanese Patent Application No. 108602/1984). The present invention is an improved version of the same.

SUMMARY OF THE INVENTION

The present invention has been accomplished with the above in mind, and a first object of the invention is to provide a rotary hammer of the construction in which a vibrating mechanism driven by an electric motor installed in the hammer body through a motion conversion transmission device which converts rotation into reciprocating motion imparts axial percussive vibrations to a tool, such as a drill bit, held at the front end of the hammer body while rotation is imparted to said tool by transmission of rotation from an electric motor, said rotary hammer being characterized in that the hammer body has a (1) an electric motor section which comprises receiving section for receiving transmission mechanisms including a motion conversion transmission device and the vibrating mechanism, inside a frame which serves as a shell barrel which opens axially of the vibrating mechanism, and in which a driving electric motor is installed with its axis extending parallel to the axis of the vibrating mechanism adjacent said receiving section, (2) a vibration and transmission mechanism section in which the transmission mechanisms including the motion conversion transmission mechanism and the vibrating mechanism having a guiding cylinder internally provided with a piston-like drive member and a striker are held by a bracket removably connected to one opening in the frame of said electric motor section, and (3) a tool holding section in which tool holding member for concomitantly rotatably holding the tool is rotatably supported by a bracket removably connected to the other opening in the frame of said electric motor section associated with the side for receiving the vibrating mechanism and the like, and in that these three sections are so arranged that they can be assembled and disassembled individually as separate component units, thereby facilitating assembly manufacture and disassembly and assembly operations which are required when a machine trouble occurs or a part is to be replaced.

The present invention, with the above arrangement, is intended to provide a rotary hammer wherein the hammer body as well as the shell is rationally constructed to facilitate assembly manufacture of components and performance tests and replacement and repair of parts in the field and wherein accuracy and durability required by a percussive tool can be easily attained.

Another object of the invention is to provide a rotary hammer wherein a bracket for a vibration and transmission mechanism section and a frame for an electric motion section are removably clamped together as by screws which are capable of clamping the peripheral edge of said bracket and the open end of said frame, thereby facilitating connection and separation thereof.

Another object of the invention is to provide a rotary hammer wherein a bracket for a tool holding section and a frame for an electric motor section are detachably joined together by fastening means such as screws capable of fastening together the peripheral edge of said bracket and the open end of said frame, thereby facilitating connection and separation thereof.

Another object of the invention is to provide a rotary hammer wherein a bracket for a tool holding section has a holding bracket inside a bracket forming a portion of the shell, and these brackets are connected to a bracket for an electric motor by fastening means.

A further object of the invention is to provide a rotary hammer wherein a portion of a mechanism for transmitting rotation from an electric motor to a tool holding member included in a tool holding section is adapted to be removably fitted to a cylinder for a vibration and transmission mechanism, so that component units can be individually assembled and disassembled.

In the rotary hammer of the present invention, the electric motor section having an electric motor installed in a frame serving as the shell barrel of the hammer body, the tool holding section holding a tool such as a drill bit, and the vibration and transmission mechanism section are so arranged that these sections can be assembled and disassembled individually as separate component units; therefore, in assembly manufacture, first said component units are individually assembled and then said tool holding section and said vibration and transmission mechanism section are built into the substantially cylindrical frame of the electric motor section serving as the shell barrel through openings in opposite sides thereof, and the brackets included in the respective units are joined to said frame. Thus, they can be assembled with ease. Further, performance tests involved in this assembly operation can be conducted individually on the respective component units. For example, a performance test on the driving electric motor can be conducted with the electric motor built into the frame serving as the shell barrel, i.e., with the unit of the electric motor section alone assembled, without having to build the tool holding section into the frame.

The rotary hammer of the present invention is adapted to have its parts disassembled individually as separate component units according to functions; for example, in the case of a trouble to the tool holding section or the vibration and transmission mechanism section or replacement of a consumable part included in such section, the tool holding section or the vibration and transmission mechanism section alone can be removed and disassembled while leaving the other sections as they are, thus making it possible to cope with this situation without having to disassemble unnecessary sections.

Further, in addition to the individual functional sections constructed in separate component units, the fact that the shell is split at right angles to the axis of the vibrating mechanism and is substantially cylindrical results in a smaller number of fastening parts, such as screws, for joining the individual component units and sufficient assembly strength; thus, as compared with the type split along the axis, it suffers little slack due to vibrations or shocks, is excellent in shock resistance and facilitates attainment of the required accuracy of assembly.

Thus, in the invention, assembly manufacture is easy and performance tests involved in manufacture can be conducted separately on the individual units. Further, such units can be used in other types of rotary hammers. For repair of an internal mechanism or replacement of a part, there is no need to carry the rotary hammer to the factory and instead the necessary component unit can be efficiently disassembled and then assembled in the location where the rotary hammer is used. Moreover, the rotary hammer has sufficient durability and reliability required by a percussion tool.

These and other objects and features will become more apparent from the following detailed description to be given with reference to the accompanying drawings.

DESCRIPTION OF THE PREFERRED EMBODIMENTS

Figure 1:
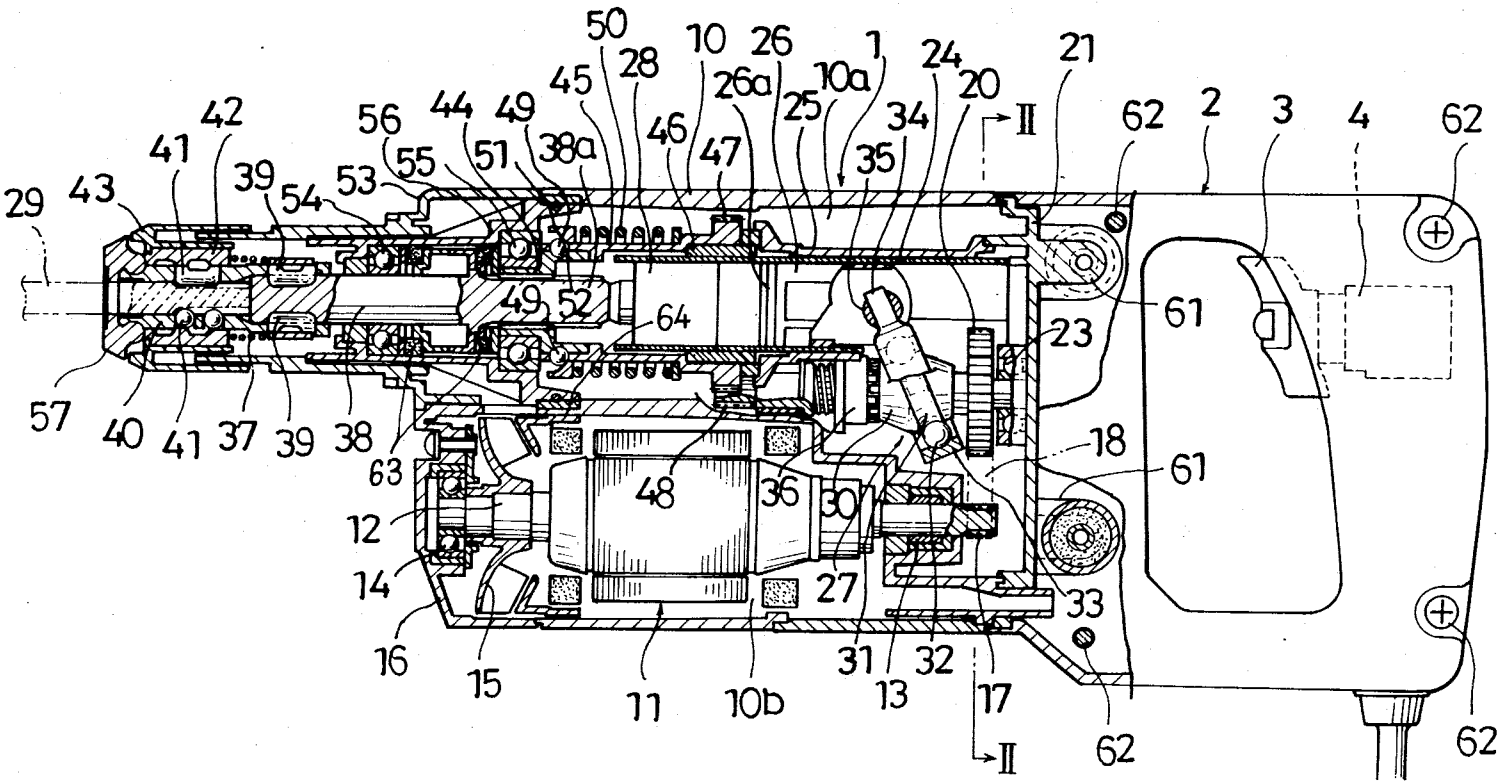
FIG. 1 is a side view, partly in longitudinal section, of a rotary hammer according to an embodiment of the invention.

In FIG. 1 showing a rotary hammer in its assembled state, 1 denotes a hammer body and 2 denotes a grip section provided with a trigger type operating element 3 for turning on and off an internal switch 4 so as to operate a driving electric motor installed in the hammer body 1. The hammer body 1 in the illustrated embodiment is constructed approximately as follows.

The numeral 10 denotes a frame serving as the barrel of the shell of the hammer body 1, internally having a receiving section **10*a* for receiving a vibrating mechanism and a transmission mechanism to be later described, and a receiving section 10*b* for receiving a driving electric motor 11, an adjacent relation to each other, which frame 10 is substantially cylindrical and opens axially of said vibrating mechanism. This frame 10 is made of plastic material for reducing the weight. The electric motor 11 is installed in said receiving section 10***b* of said frame 10 with its rotor shaft 12 rotatably supported at its opposite ends in bearings 13 and 14, said rotor shaft 12 having a vane wheel 15 fixed thereon. The bearing 13 on the output side of the rotor shaft 12 is held in a portion 10*c* of the frame 10, while the other bearing 14 is held in a bracket 16 fixed to the frame 10 by fastening means such as screws (not shown). These components form an electric motor section A to be later described.

Figure 2:
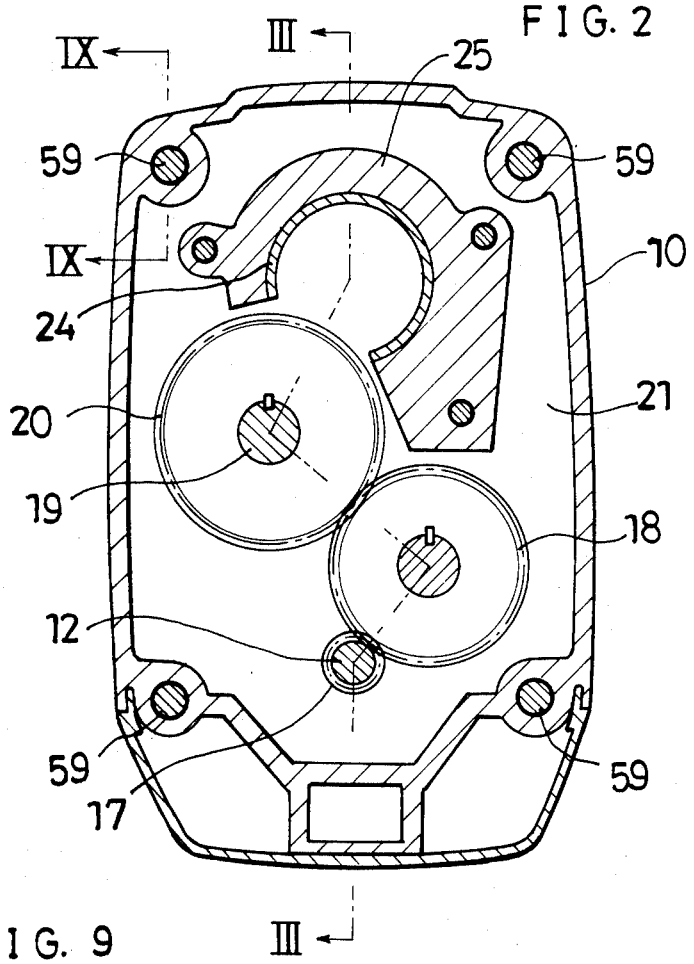
FIG. 2 is an enlarged sectional view taken along the line II—II in FIG. 1.
Figure 3:
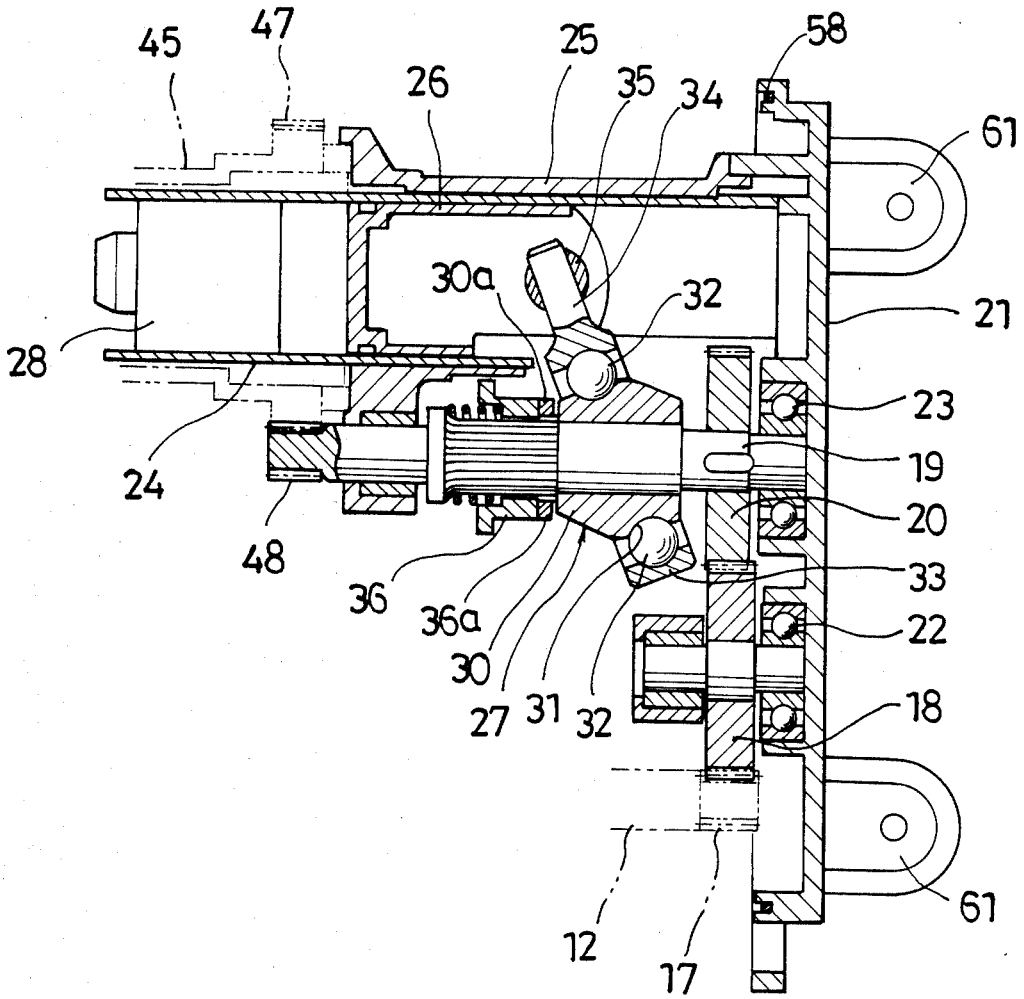
FIG. 3 is a sectional view taken along the line III—III in FIG. 2, showing a vibration and transmission mechanism section.

The output end of said rotor shaft 12 is provided with a pinion 17 meshing with a transmission gear 18 and is connected to a gear 20 on an intermediate shaft 19 through said transmission gear 18, whereby the rotation of the electric motor 11 is reduced and transmitted to the intermediate shaft 19. FIGS. 2 and 3 show the manner of transmission connection. The transmission gear 18 being interposed between the pinion 17 and the gear 20 on the intermediate shaft 19 is effective in avoiding an increase in the diameter of said gear 20 and hence an increase in reduction ratio. The transmission gear 18 and intermediate shaft 19 are supported at one of their respective shaft ends by bearings 22 and 23, respectively, held in a bracket 21 jointed to said frame 10 and at the other ends by a holding bracket 25 to be later described. Further, a guide cylinder 24 is held by the holding bracket 25 with its axis extending parallel to said intermediate shaft 19 and is attached to said bracket 21, and a piston-like drive member 26 serving as a vibrator adapted to reciprocate axially of said cylinder 24 is slidably fitted in said cylinder 24 in sealed condition established by a seal ring 26a. This structure constitutes a vibrating mechanism for imparting percussive vibration energy to the tool. The drive member 26 is connected to said electric motor 11 through a transmission mechanism including a motion conversion transmission device 27 which converts rotary motion into axial reciprocating motion, so that as the rotation of the electric motor 11 is conversion-transmitted, the drive member 26 is driven for reciprocating motion.

The cylinder 24 has a striker 28 axially movably fitted therein with some air gap between it and said drive member 26, so that the striker 28 is struck for axial motion by the reciprocating motion of said drive member 26 through elastic spring means provided by air, said striker 28 imparting percussive vibration energy to a drill bit or other tool 29 which is held at the front end of the hammer body 1 by a tool holding member to be later described. These components form a unit constituting a vibration and transmission mechanism section 8 to be later described.

In the illustrated embodiment, the motion conversion transmission device 27 comprises a cam drum 30 concomitantly rotatable through a clutch mechanism mounted on said intermediate shaft 19 extending parallel to the axis of the cylinder 24, the outer periphery of said cam drum 30 being formed with an annular groove 31 having an axis which is inclined with respect to the axis of said intermediate shaft 19, a ring 33 fitted over said annular groove 31 with balls 32 interposed therebetween, a plunger 34 radially extending from said ring 33 to form an output portion, the end of said plunger 34 extending through and engaged by a pin socket 35 attached to the piston 26 which is the vibrator of said vibrating mechanism, the arrangement being such that when the cam drum 30 is rotated by the rotation of the intermediate shaft 19, the piston 26 is axially reciprocated through the plunger 34 rocked by said inclined annular groove 31. The clutch mechanism for said cam drum 30 is constructed by loosely mounting the cam drum 30 on the intermediate shaft 19, axially slidably and concomitantly rotatably mounting a clutch member 36 on said intermediate shaft 19, and forming the respective opposed surfaces of the two with clutch teeth 30*a* and 36*a*, the arrangement being such that when the teeth 30*a* and 36*a* are in engaged condition, rotation is transmitted from the intermediate shaft 19 to the cam drum but when the teeth 30*a* and 36*a* are disengaged, it is held in no-rotation transmitted condition, i.e., a condition in which the vibrating mechanism is inactive. An operating knob (not shown) for slidably operating said clutch member projects laterally from the frame 10.

A tool holding member 37 comprises a shaft-like intermediate member 38 disposed coaxially with said cylinder 24, and a holding sleeve 40 connected to said intermediate member 38 through a connecting member 39. The shank end of the drill bit or other tool inserted in said holding sleeve 40 is concomitantly rotatably held therein by locking means 41 such as a torquetransmitting key or balls. The numeral 42 denotes an operating ring internally formed with a cam adapted to fit in a recess in the shank end, said operating ring having a protective sleeve 43 fitted thereon. The spline shaft portion 38*a* of said intermediate member 38 is axially movably spline-fitted in an inner sleeve 44 forming a portion of a rotation transmitting mechanism, so that it can be axially displaced by the percussive action of said striker 28. An outer sleeve 45 cooperating with said inner sleeve 44 to form a portion of the rotation transmitting mechanism is loosely fitted at one end thereof on the inner sleeve 44 and rotatably fitted at the other end thereof on the cylinder 24 through a bearing 46, said outer sleeve 45 having a gear 47 which meshes with a pinion 48 formed on the end of said intermediate shaft 19, whereby the rotation of said electric motor 11 is reduced and transmitted to the outer sleeve 45. Balls 49 fitted and held in throughgoing holes in the outer sleeve 45 are installed between the loose fitting portions of the outer and inner sleeves 44 and 45 and inwardly urged by a spring 50 through a ball guide 51, said balls being fitted in dish-shaped recesses 52 formed in the outer periphery of the inner sleeve 44. Thus, the rotation of the outer sleeve 45 is transmitted to the inner sleeve 44 to rotate the tool holding member 37. When the tool 29 is in locked condition, the balls 49 are forced out of the recesses 52 in the inner sleeve 44 against the resilient force of the spring 50 to allow idle rotation; this is a rotation slip device.

The tool holding member 37 is rotatably supported, at the intermediate member 38 and at the inner sleeve 44 of the rotation transmitting mechanism, in a holding bracket 56 inside a substantially cylindrical bracket 53 forming a portion of the shell, and through bearings 54 and 55. The bracket 53 and the holding bracket 56 are joined as by screws to the opening in said frame 10 on the side associated with the receiving section 10*a* for receiving the vibrating mechanisms and the like, a fact which, coupled with the fact that the outer sleeve 45 of the rotation transmitting mechanism fits on the cylinder 24, ensures that tool holding member 37 is held accurately coaxially with the cylinder 24. The numeral 57 denotes a rubber cover mounted on the front end of the tool holding member 37. The numeral 63 denotes a rubber buffer for absorbing shocks due to percussive vibrations. These components form a unit which constitutes a tool holding section C.

Thus, in the present invention, the hammer body 1 having the arrangement described above has its component sections, i.e., the electric motor section A, the vibration and transmission mechanism section B and the tool holding section C, constructed as units which are combined so that they can be assembled and disassembled.

Figure 4A:
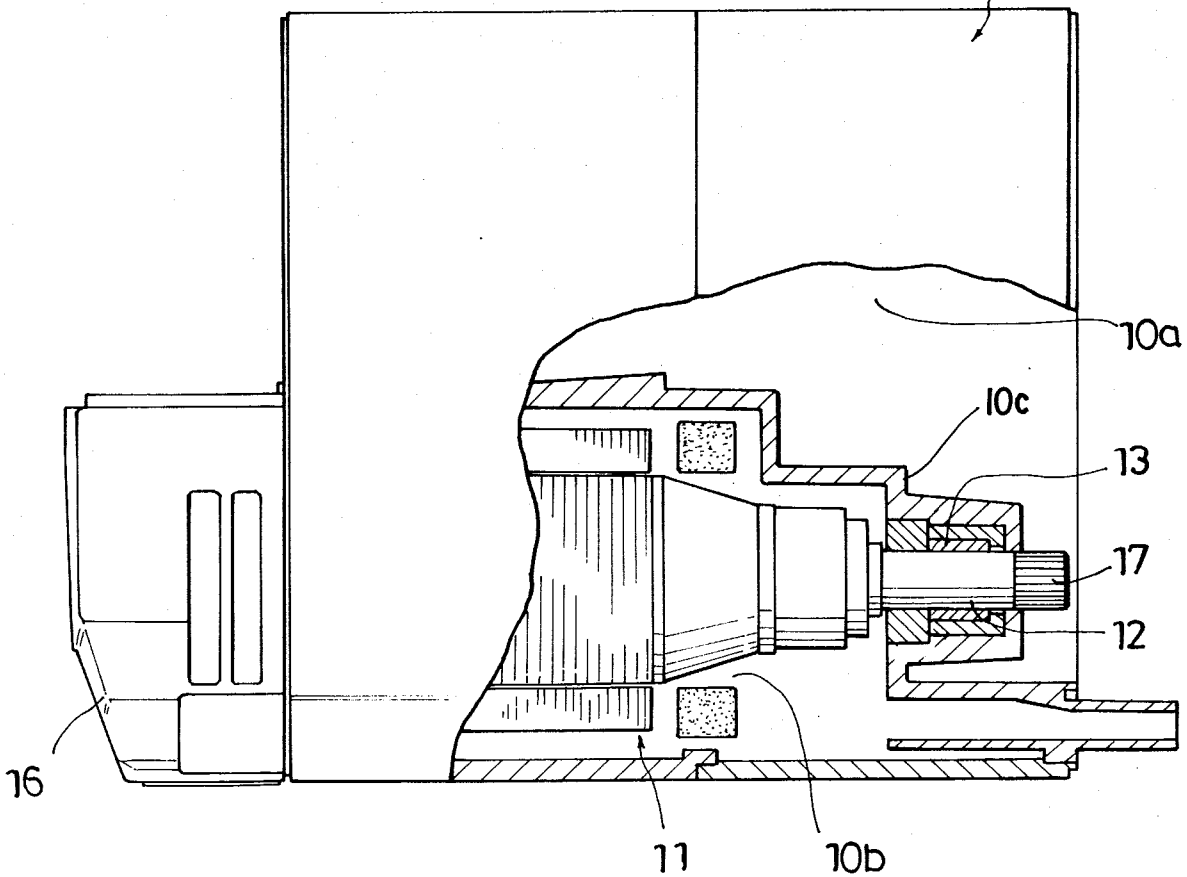
FIG. 4 is a side view, partly broken away, of an electric motor section.
Figure 5:
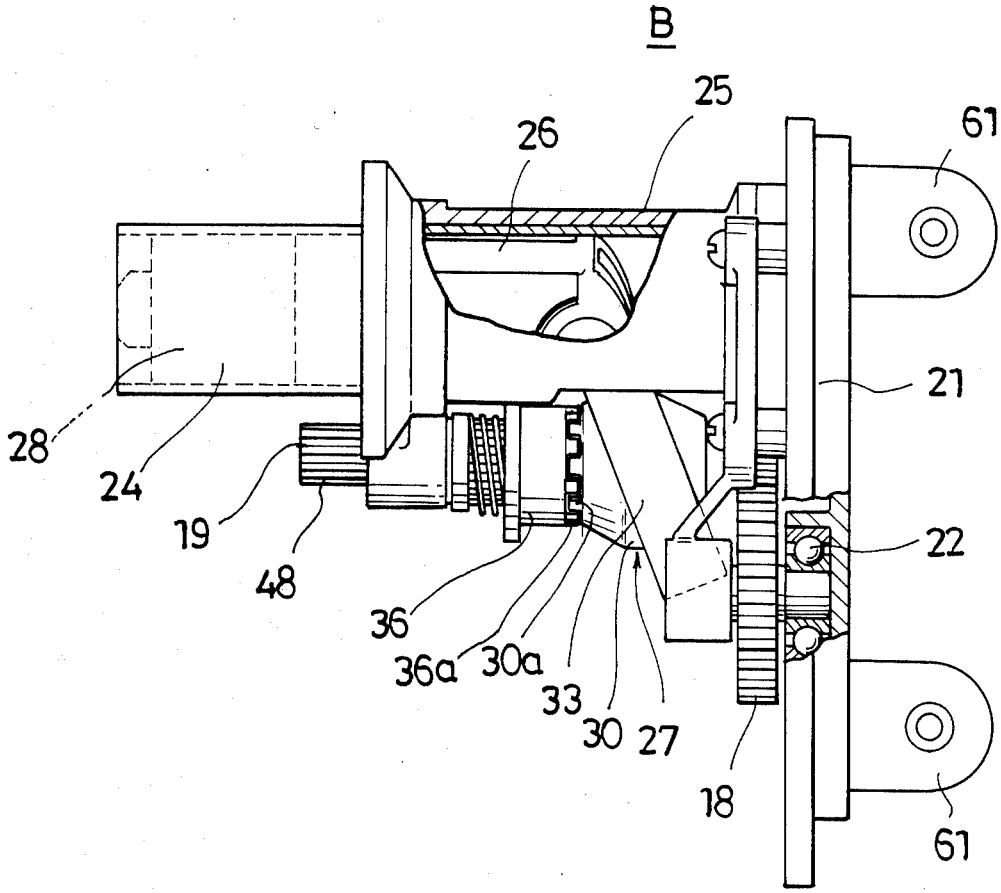
FIG. 5 is a side view, partly broken away, of a vibration and transmission mechanism section.
Figure 6:
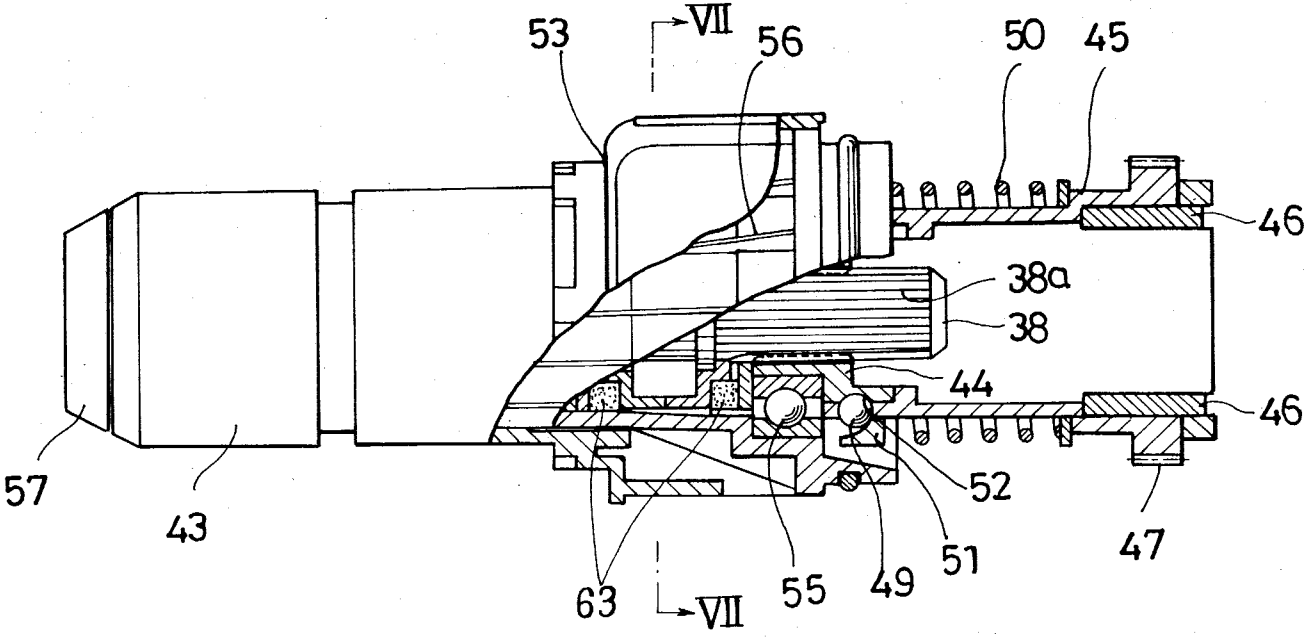
FIG. 6 is a side view, partly broken away, of a tool holding section.
Figure 7:
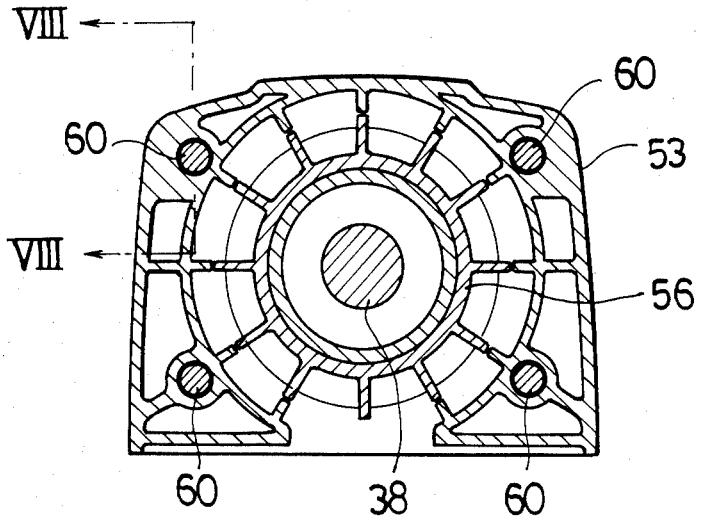
FIG. 7 is a sectional view taken along the line VII—VII in FIG. 6.

That is, disposed inside the substantially cylindrical frame serving as said sheel barrel are the motor section A in which the electric motor 11 is installed with its axis extending parallel to the axis of the vibrating mechanism and adjacent the receiving portion for receiving the transmission mechanisms including the vibrating mechanism and motion conversion transmission device 27, the vibration and transmission mechanism section B in which the vibrating mechanism with the cylinder 24 internally provided with the piston 26 and striker 28 and the transmission mechanism including the motion conversion transmission device 27 and intermediate shaft 19 are integrally held by the bracket 21, and the tool holding section C in which the tool holding member 37 which concomitantly rotatably holds the tool 29 such as a drill bit is supported by the bracket 53, said sections A-C being assembled individually as separate component units, as shown in FIGS. 4–6, and combined to thereby constitute the hammer body 1; thus, it can be assembled and disassembled unit by unit.

Figure 9:
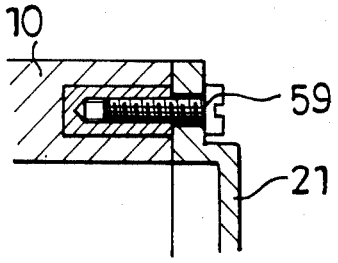
FIG. 9 is a sectional view taken along the line IX—IX in FIG. 2.

To this end, the means for joining the bracket 21 for said vibration and transmission mechanism section B to the frame 10 for the electric motor section A is embodied in such a manner that as shown in the drawings the peripheral edge of the bracket 21 and the open end of the frame 10 are fitted together in sealed condition through a packing 58 and as shown in FIG. 9 the two are joined together at a plurality of locations on their peripheral edges by fastening means 59 such as screws extending through the perpheral edge of the bracket 21 and inserted in threaded holes in the frame 10; thus, the two can be connected to or disconnected from each other by tightening or loosening said fastening means 59.

Figure 8:
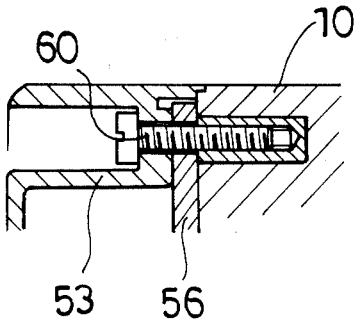
FIG. 8 is a sectional view taken along the line VIII—VIII in FIG. 7.

The means for joining the bracket 53 and the holding bracket 56 for the tool holding section C to the frame 10 for the electric motor section A is embodied in such a manner that as shown in the drawings the connection end of the holding bracket 56 separate from the bracket 16 which supports the electric motor 11 is fitted in the open end of the receiving portion 10*a* of the frame 10 where the metal ring 64 is mounted and as shown in FIG. 8 the two are joined together at a plurality of locations on their peripheral edges by fastening means 60 such as screws extending through the peripheral edges of the bracket 53 and holding bracket 56 and inserted in threaded holes in the frame; thus, the two can be connected to or disconnected from each other by tightening or loosening said fastening means 60. This joining arrangement is also applicable to the case where the two brackets 53 and 56 are integrally formed.

Thus, the assembly manufacture of said rotary hammer can be attained by individually assembling said electric motor section A, vibration and transmission section B, and tool holding section C unit by unit, building the vibration and transmission section B and tool holding section C into the frame 10 of the electric motor section A through its opposite openings, fitting together the cylinder 24 of the vibration and transmission mechanism section B and the outer sleeve 45 of the rotation transmitting mechanism of the tool holding section C at the bearing 46, meashing the pinion 17 on the rotor shaft of the electric motor 11 with the transmission gear 18 and meshing the pinion 48 on the intermediate shaft 19 with the gear 47 of the outer sleeve, and joining the brackets 21, 53 and 56 to the open ends of said frame 10 by the fastening means 59 and 60. In this manner it can be easily assembly-manufactured. Further, an operation performance test on the electric motor can be conducted with the electric motor section alone before the vibration and transmission mechanism section B and tool holding section C are built in.

Further, if a trouble occures inside the tool holding section C or the vibration and transmission mechanism section B or if there is a need to replace a consumable part such as a seal ring for the piston 26, only the unit forming the tool holding section C or the vibration and transmission mechanism section B, which includes said trouble or said part to be replaced, may be removed from the frame 10 by loosening the fastening means 59 or 60; thus, repair and replacement of parts can be made without having to disassemble the other sections, and the subsequent assembly can also be easily made in the same manner as the above.

In addition, the grip portion 2 is made of synthetic resin and is of split type vertically longitudinally divided such that the two halves are put together to hold projections 61 on the bracket 21 of the hammer body 1 along with rubber buffers therebetween and are then clamped by fastening means 62 such as bolts and nuts.

The hammer body 1 of the invention is not limited to the construction described above. For example, bevel gears and a crank may be used to convert rotary motion into reciprocating motion. Thus, in embodying the invention, changes or modifications may be made without departing from the scope of Claims.

What is claimed is:

1. In a rotary hammer having a hammer body with a grip section attached to a rear end thereof, said hammer body comprising:

an electric motor with its axis extending parallel to the axis of said hammer body, a motion conversion transmission device for converting rotary motion of said electric motor to axial reciprocating motion acting along a line parallel to the axis of said hammer body, a vibrating mechanism including a guide cylinder extending parallel to the axis of said hammer body, said guide cylinder having therein a piston-like drive member which reciprocates axially through said axial reciprocating motion obtained by said motion conversion transmission device, and a striker which is in turn moved axially in a reciprocating manner by said drive member, and a tool holding member at a forward end of said hammer body and in alignment with said vibrating mechanism, said tool holding member being adapted to hold a tool so that said tool can be concomitantly rotated by said electric motor with said tool holding member and can be moved by said striker in an axially reciprocating manner; the improvement wherein said hammer body comprises:

an electric motor section including a tubular frame open at both axial ends and defining a shell barrel of said hammer body, said frame having first and second chambers positioned laterally of one another in the interior thereof, said first chamber receiving said motion conversion transmission device and said vibrating mechanism, said second chamber receiving said electric motor therein with one end of its rotor shaft supported by a first bracket means mounted at a forward opening of said frame and the other end of its rotor shaft supported by a support which comprises an inner extension of said frame, a vibration-transmission mechanism section including a second bracket means detachably mounted on a rear opening of said frame of said electric motor section, said second bracket means supporting said vibrating mechanism and said motion conversion transmission device, said motion conversion transmission device having a shaft with one end supported in a bearing held by said second bracket means and the other end supported by a holding bracket having a portion extending along the axis of said hammer body from said second bracket means, and a tool holding section including third bracket means detachably mounted at the forward opening of said frame and adjacent said first bracket means, said third bracket means supporting said tool holding member, said vibrating-transmission mechanism section and said tool holding section being shaped to be inserted through respective openings of said frame of said electric motor section during assembly, first fastening means for fastening together said second bracket means and said rear end of said frame of said electric motor section when said vibration-transmission section is inserted in said frame, said third bracket means being fastened to the forward end of said frame of said electric motor section by second fastening means, whereby said rotor shaft is supported in said frame independently of the presence on said frame of said second and third bracket means.

2. The hammer body of claim 1 wherein said shaft extends parallel to said axis of said hammer body, and said portion of said holding bracket extending along said axis of said hammer body supports said guide cylinder, a further portion of said holding bracket projecting radially at the forward end of said axially extending portion thereof for supporting said other end of said shaft.

3. The hammer body of claim 1 wherein said third bracket means of said tool holding section is cylindrical and has an opening conforming substantially with the forward opening of said frame, and further comprising bearings in said third bracket means for supporting an intermediate member for axial movement along the axis of said hammer body, said intermediate member being mounted to be axially struck by said striker, a holding sleeve for supporting said tool, and a connecting member for connecting said intermediate member to said holding sleeve.

4. The hammer body of claim 3 further comprising inner and outer sleeves, means coupling said inner sleeve for rotation with said outer sleeve, a spline connection between said inner sleeve and said intermediate member for rotating said intermediate member with said inner sleeve while permitting relative axial movement of said intermediate member, said first and second sleeves being loosely fitted within said cylinder of said vibrating mechanism and comprising means for transmitting rotation of said electric motor to said tool holding member.

* * * * *